US007363961B2

(12) United States Patent
Mori et al.

(10) Patent No.: US 7,363,961 B2
(45) Date of Patent: Apr. 29, 2008

(54) HEAT EXCHANGER SUPPORT STRUCTURE OF MOTOR VEHICLE AND SUPPORTING METHOD

(75) Inventors: Takeshi Mori, Nakano-Ku (JP); Satoshi Haneda, Nakano-Ku (JP)

(73) Assignee: Calsonic Kansei Corporation, Tokyo (JP)

( * ) Notice: Subject to any disclaimer, the term of this patent is extended or adjusted under 35 U.S.C. 154(b) by 610 days.

(21) Appl. No.: 10/929,576

(22) Filed: Aug. 31, 2004

(65) Prior Publication Data

US 2005/0051309 A1 Mar. 10, 2005

(30) Foreign Application Priority Data

Sep. 10, 2003 (JP) ..... 2003-318815

(51) Int. Cl.

| | |
|---|---|
| ***F01N 1/08*** | (2006.01) |
| ***F01P 11/10*** | (2006.01) |
| ***F01P 9/04*** | (2006.01) |
| ***F01P 7/10*** | (2006.01) |
| ***F04D 29/54*** | (2006.01) |

(52) U.S. Cl. ..... 165/41; 165/51; 165/121; 165/122; 123/41.49; 180/68.4

(58) Field of Classification Search ..... 165/121, 165/122, 41, 51; 180/68.4; 123/41.49
See application file for complete search history.

(56) References Cited

U.S. PATENT DOCUMENTS

| | | | | |
|---|---|---|---|---|
| 4,805,868 | A * | 2/1989 | Claude | 165/122 |
| 5,131,352 | A * | 7/1992 | Hoshino et al. | 123/41.49 |
| 5,180,279 | A * | 1/1993 | McLane-Goetz et al. | 415/177 |

FOREIGN PATENT DOCUMENTS

| | | | |
|---|---|---|---|
| JP | 63105299 | A * | 5/1988 |
| JP | 01083899 | A * | 3/1989 |
| JP | 2002-114025 | | 4/2002 |
| JP | 2002-160665 | | 6/2002 |

* cited by examiner

*Primary Examiner*—John K. Ford
(74) *Attorney, Agent, or Firm*—Wenderoth, Lind & Ponack, L.L.P.

(57) ABSTRACT

A heat exchanger support structure has a heat exchanger, a heat exchanger support supporting the heat exchanger, and motor fan units. The heat exchanger support is integrally formed with motor fan shroud portions for directing the air flow caused by motor fans. Electric motors driving the fans are respectively surrounded by a cylindrical shroud member, which has stays received in holding portions formed on the shroud portion with an elastic member interposed between the stay and the holding portion. The arrangement of the shroud member, the motor fan unit, and the elastic member functions as a dynamic damper.

20 Claims, 7 Drawing Sheets

HEAT EXCHANGER SUPPORT STRUCTURE OF MOTOR VEHICLE AND SUPPORTING METHOD

BACKGROUND OF THE INVENTION

1. Field of the Invention

The present invention relates to a heat exchanger support structure of a motor vehicle and a heat exchanger supporting method for supporting a motor fan and its electric motor on a motor fan shroud or the like.

2. Description of the Related Art

A heat exchanger support structure of this kind is disclosed in Japanese patent laying-open publication (Tokkaihei) No. 2002-114025. This support structure has a radiator for cooling coolant of an engine, a condenser for cooling refrigerant of an air conditioner, and a motor fan and an electric motor which are located inside of and supported to a motor fan shroud. The radiator is arranged between the condenser and the fan shroud, so that the condenser is held by fixtures and bolts on the one side of the radiator and the fan shroud is directly bolted on the opposite side thereof.

A problem with the above known conventional support structure is that vibration of the electric motor due to dynamic imbalance of the motor fan is directly transmitted to the fan shroud, and then to the radiator and the condenser, and still further to a vehicle body through radiator mounting rubbers consequently degenerating a vibration performance and a noise level of a motor vehicle and impairing ride quality.

Another heat exchanger support structure of this kind is disclosed in Japanese patent laying-open publication (Tokkaihei) No. 2002-160665. In this support structure, a motor fan shroud supports an electric motor fan unit and is separated from a radiator or a condenser to be integrally formed with a radiator core support mounted to a front end portion of a motor vehicle.

A problem with this conventional support structure is that vibration of the electric motor is directly transmitted to the fan shroud, then to the radiator core support and further, to the vehicle body, consequently degenerating a vibration performance and a noise level of a motor vehicle and impairing ride quality.

It is, therefore, an object of the present invention to provide a heat exchanger support structure of a motor vehicle which overcomes the foregoing drawbacks and which is capable of suppressing vibration transmitted from an electric motor driving a motor fan to a heat exchanger and a motor vehicle body due to dynamic imbalance of the motor fan.

SUMMARY OF THE INVENTION

According to a first aspect of the present invention there is provided a heat exchanger support structure of a motor vehicle including a heat exchanger; a motor fan to supply the heat exchanger with air flow, an electric motor driving the motor fan, a heat exchanger support supporting the heat exchanger, a motor fan shroud fixed on one of the heat exchanger and the heat exchanger support and allowing the air flow caused by the motor fan to pass through the motor fan shroud, and a cylindrical shroud member which supports the electric motor and surrounds an outer periphery of the motor fan. The cylindrical shroud member has a plurality of stays each of which is resiliently supported to the motor fan shroud with an elastic member interposed between the stay and the motor fan shroud. The motor fan shroud is provided with a plurality of holding portions for respectively holding the elastic member, and the elastic member is formed in a rectangular tube shape with a hole to receive an inserting portion of the stay of the cylindrical shroud member.

According to a second aspect of the present invention there is provided a heat exchanger supporting method including the steps of supporting a heat exchanger on a heat exchanger support, fixing a motor fan shroud provided with a plurality of holding portions on one of the heat exchanger and the heat exchanger support, fixing an electric motor having a motor fan to a cylindrical shroud member which surrounds an outer periphery of the motor fan, and resiliently supporting a plurality of stays of the cylindrical shroud member to the motor fan shroud with an elastic member which is formed in a rectangular shape with a hole to receive an inserting portion of the stay of the cylindrical shroud member and which is held by the holding portion of the motor fan shroud between the stay and the motor fan shroud.

Preferably, the cylindrical shroud member has an upstream portion having the same (constant) internal diameter and a downstream edge portion whose internal diameter is extended compared to the upstream portion.

Preferably, the motor fan shroud and the heat exchanger support are integrally formed out of resin with each other.

Preferably, the cylindrical shroud member is disposed to have a clearance in a radial direction of the motor fan between the cylindrical shroud member and the motor fan shroud, the motor fan shroud being provided at an inner edge portion thereof with a covering portion which covers the clearance so that the air flow through the clearance is blocked.

Preferably, the first elastic members resiliently support the stays of the cylindrical shroud member in all directions.

Preferably, the motor fan shroud is provided with a plurality of holding portions to respectively hold the elastic member, the elastic member being formed in a cylindrical shape with a hole to receive the stay of the cylindrical shroud member.

Preferably, the holding portion includes an upper holding portion having a first holder integrally formed to the motor fan shroud and a second holder attachable to and detachable from the first holder, the first and second holders holding the elastic member.

Preferably, the holding portion includes a lower holding portion shaped like a box which opens upwardly and receives the elastic member.

BRIEF DESCRIPTION OF THE DRAWINGS

The objects, features and advantages of the present invention will become apparent as the description proceeds when taken in conjunction with the accompanying drawings, in which.

DESCRIPTION OF THE PREFERRED EMBODIMENTS

Figure 1:
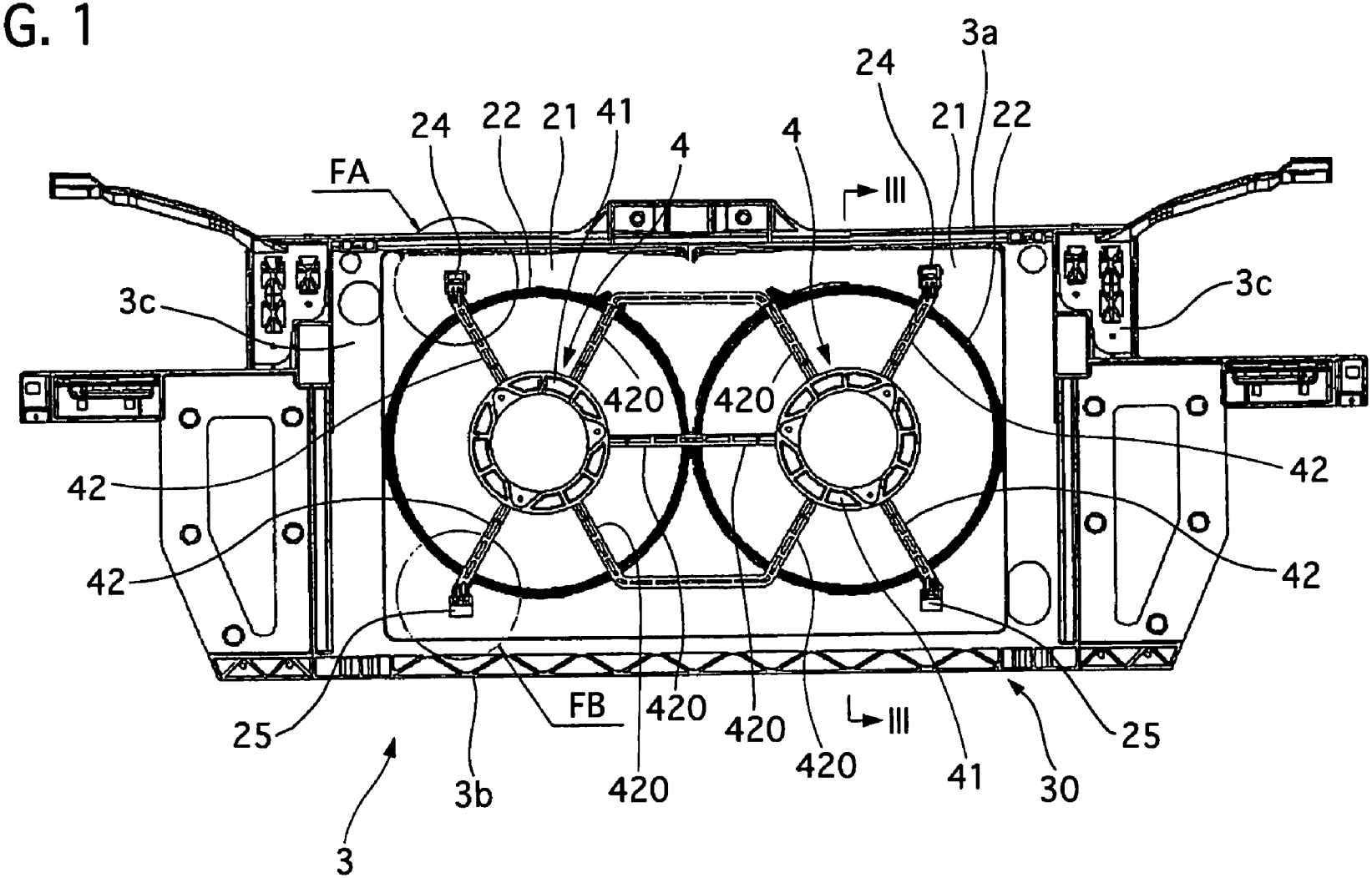
FIG. 1 is a rear view showing a heat exchanger support structure of a motor vehicle of a preferred embodiment according to the present invention.

In the following, a heat exchanger support structure of the present invention will be described in detail with reference to the accompanying drawings. Throughout the following detailed description, similar reference characters and numbers refer to similar elements in all figures of the drawings.

Figure 2:
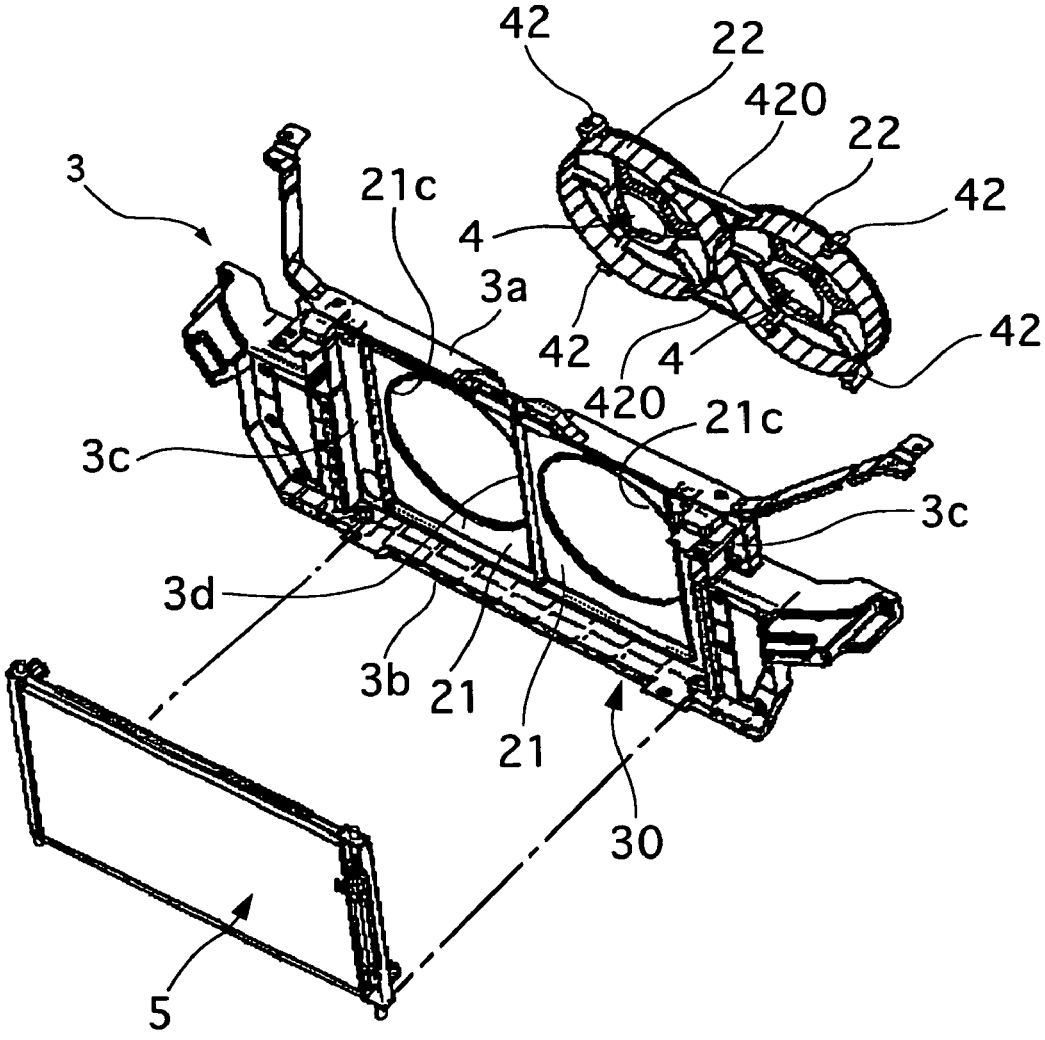
FIG. 2 is an exploded perspective view of the heat exchanger support structure shown in FIG. 1 wherein a heat exchanger and cylindrical shroud members, respectively provided with a motor fan unit, are removed from a heat exchanger support formed with motor fan shroud portions.
Figure 3:
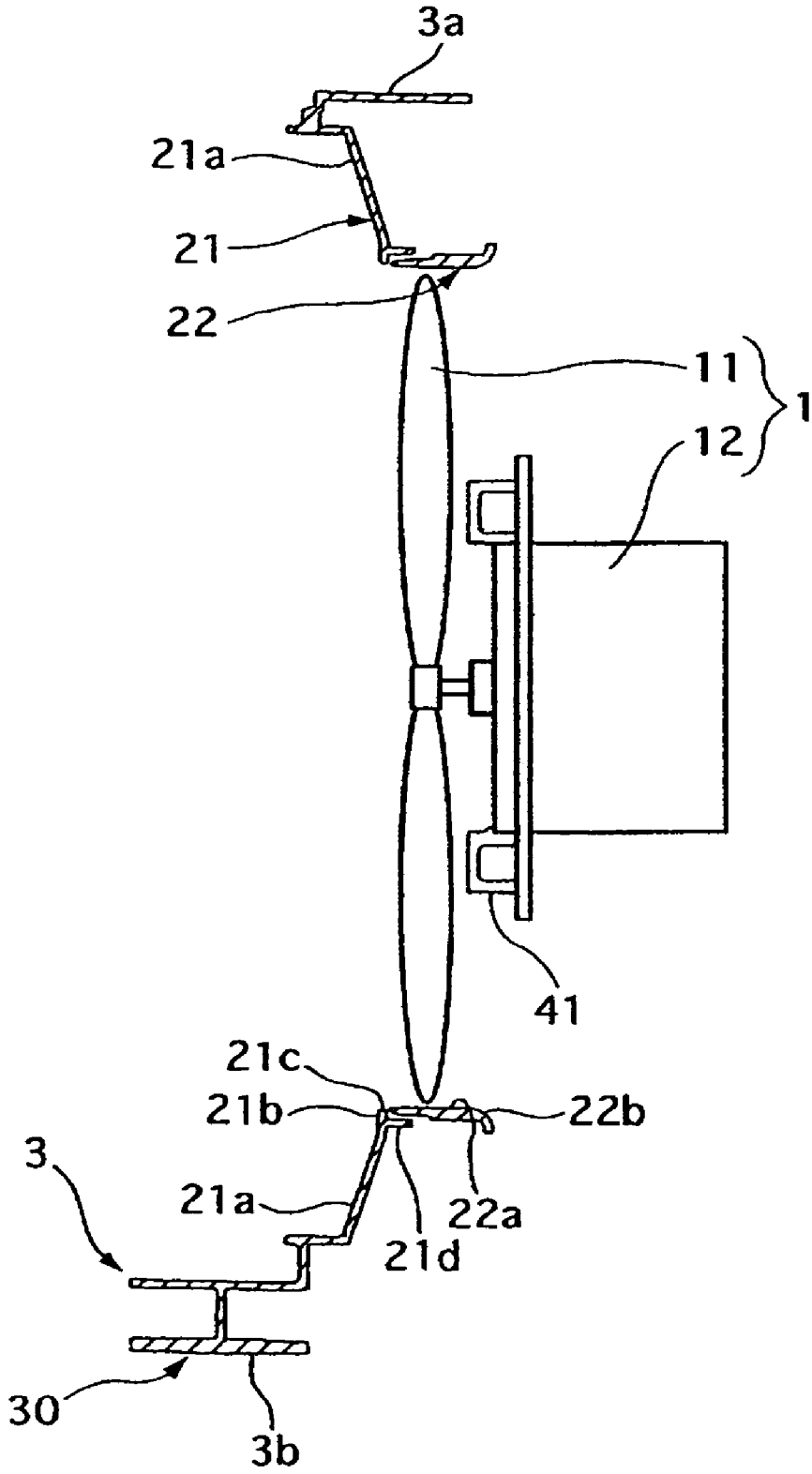
FIG. 3 is a cross sectional side view taken along the line III-III in FIG. 1 and showing the motor fan shroud portion and the cylindrical shroud member with the motor fan unit.

Referring to FIGS. 1 to 3 of the drawings, there is shown a first preferred embodiment of a heat exchanger support structure according to the present invention.

The heat exchanger support structure, as a front end module, is mounted to the front end portion of a motor vehicle body, not shown. The support structure includes a heat exchanger 5 for cooling coolant of an engine and/or refrigerant of an air conditioner by air flow entering the heat exchanger 5, a heat exchanger support 3 mounted to the vehicle body to resiliently support the heat exchanger 5, and two sets of motor fan units 1, one of which being shown in FIG. 3, to ensure adequate air flow through the heat exchanger 5.

As the heat exchanger 5, a radiator is adopted in this embodiment, which may be replaced by a condenser, or both a radiator and a condenser.

The heat exchanger support 3 includes a main frame 30 shaped like a rectangular configuration to have sufficient mechanical strength. The heat exchanger support 3 is integrally formed at its rear side with two motor fan shroud portions 21 and 21 to respectively receive a motor fan 11 therein to improve air flow in the motor fan shroud portion 21.

The main frame 30 is equipped with an upper support member 3*a*, a lower support member 3*b* in parallel to the upper support member 3*a*, and right and left side support members 3*c* and 3*c* connecting the upper and lower support members 3*a* and 3*b* at their right and left end portions. The upper support member 3*a* is made of steel and/or resin in this embodiment, while they may be made of one or a combination of resin, steel, stainless, and the like.

The motor fan shroud portions 21 and 21 are formed out of resin and are integral with the rear side of the main frame 30. The portions 21 and 21 are separated laterally from each other with respect to a vertical rib 3*d* which connects between adjacent side portions of the right and left shroud portions 21 and 21 and also between center portions of the upper and lower support members 3*a* and 3*b* at their front sides, as shown in FIG. 1. The shroud portions 21 and 21 respectively have a conical tube portion 21*a* which is projected rearward at its front circular edge portion from the main frame 30 so that an inner surface of the tube portion 21*a* is slanted to reduce its diameter toward its rear side portion. The conical tube portion 21*a* is continuously followed at its rear side portion by a covering portion 21*b* extending inwardly in a radial direction of the shroud portion 21 and a first shroud ring portion 21*d* extending rearward in an axial direction of the shroud portion 21 from the rear side portion of the conical tube portion 21*a*.

On the outer surfaces of the conical tube portions 21*a* and 21*a* are provided upper holding portions 24 and 24 and lower holding portions 25 and 25 for resiliently supporting cylindrical shroud members 4 and 4 and the motor fan units 1 with elastic members 23, which will be described in detail later.

Each motor fan unit 1 is equipped with the motor fan 11 having plural rotating blades and an electric motor 12 located behind and driving the motor fan 11. Two sets of the motor fan units 1 are fixed on the rear sides of the cylindrical shroud members 4 and 4 which are united with each other.

Each cylindrical shroud member 4 is made out of resin and has a fixing ring portion 41 on which the motor fan unit 1 is fixed by bolts or screws, a second shroud ring portion 22 which extends in the axial direction and surrounds an outer periphery of the motor fan 11 with a fan clearance in its radial direction, and first and second stays 42 and 420 extending radially to connect the fixing ring portion 41 and the second shroud ring portion 22 with each other.

The fixing ring portions 41 and 41 respectively receive a front portion of the electric motor 12 and fix it so that the fan 11 is located in front of the fixing ring portion 41 and in the second shroud ring portion 22. The second shroud ring portion 22 has the internal diameter larger than the fan 11 and an outer diameter smaller than the internal diameter of the first shroud ring portion 21*d* of the motor fan shroud portion 21 to have a shroud clearance between them in the radial direction.

The shroud clearance is set so that the first and second shroud ring portions 21*d* and 22 do not interfere with each other while the cylindrical shroud members 4 and 4 and the motor fan units 1 are vibrated and thus moving with respect to the first shroud ring portions 21*d* due to vibration of the motor fan unit 11.

The inner edges 21*c* of the covering portions 21*b* are extended inwardly so that they cover the shroud clearances and block air flow passing through the shroud clearances, which results in improved suction efficiency of air by the motor fans 11.

The second shroud ring portions 22 respectively have an upstream portion 22*a* with an inner surface in the same (constant) diameter and a downstream edge portion 22*b* whose internal diameter is broadened toward the end compared to the upstream portion 22*a*.

The right and left cylindrical shroud members 4 respectively have two first stays 42 and three second stays 420. The first stays 42 extend outwardly beyond the second shroud ring portion 22 to be supported resiliently by the upper and lower holding portions 24 of the fan shroud portion 21 with elastic members 23 interposed between them, while the second stays 420 are connected with the second stays 420 of the adjacent cylindrical shroud member 4 so that the right and left shroud portions 4 and 4 are coupled with each other.

Figure 4:
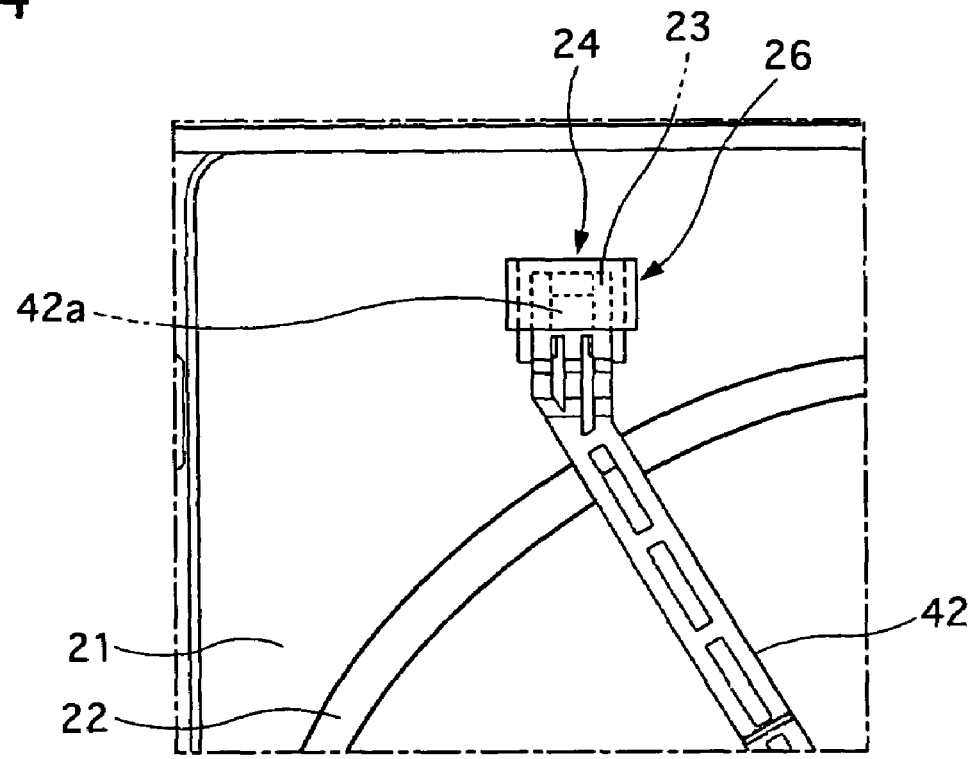
FIG. 4 is an enlarged fragmentary rear view of an upper left portion, indicated in a circle FA in FIG. 1, of the heat exchanger support structure shown in FIGS. 1 and 2, showing the motor fan shroud portion and the cylindrical shroud member with stays each extending outwardly in a radial direction thereof.
Figure 5:
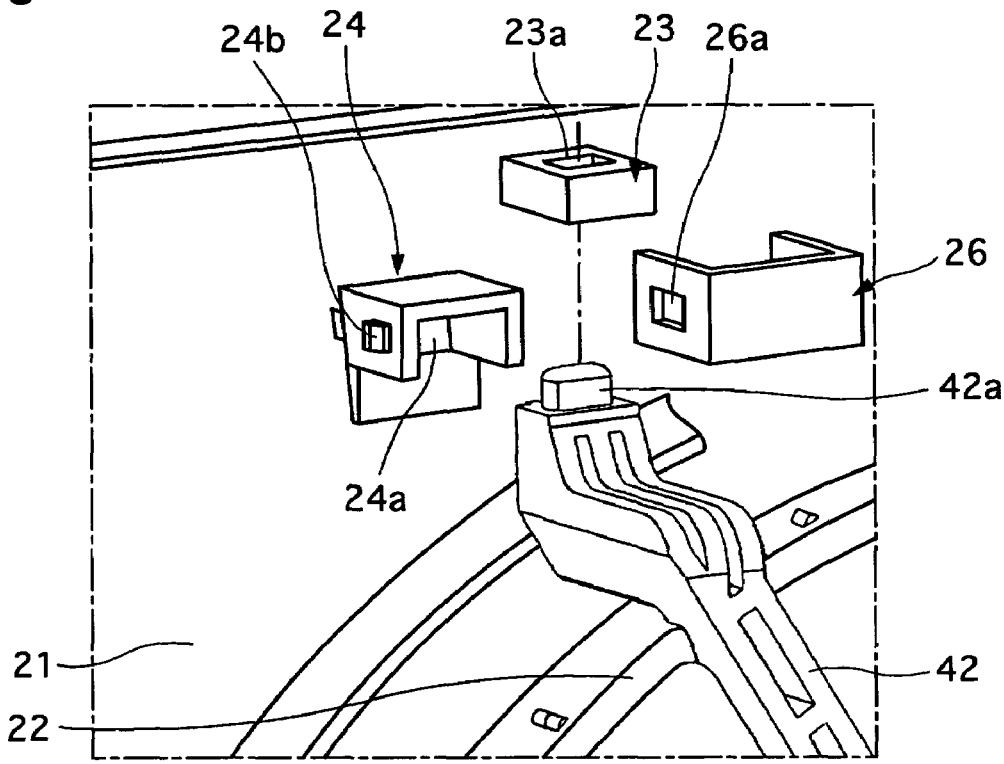
FIG. 5 is an exploded and enlarged fragmentary perspective rear view showing the upper left portion of FIG. 4, in a state that the stays of the cylindrical shroud member are removed from an upper holding portion formed on the motor fan shroud portion.

FIGS. 4 and 5 show fragmentally and with enlargement the upper left portion of the heat exchanger support structure, the first stay 42 of the left cylindrical shroud member 4 and the upper holding portion 24 formed on the left fan shroud portion 21.

As shown in FIGS. 4 and 5, the first stay 42, extending toward an upper left direction, is provided with an inserting portion 42*a* at its top, which is inserted in a hole 23*a* of the elastic member 23 shaped as a rectangular tube. The elastic member 23 is held by the upper holding portion 24 in a manner that an upper and all four side surfaces of the elastic member 23 are in contact with the inner surfaces of the upper holding portion 24.

The upper holding portion 24 consists of a first upper holder 24*b* and a second upper holder 26 easily attachable to and detachable from the first upper holder 24*b*. The first upper holder 24*b* is shaped like a channel with a top lid which opens rearward and downward: the second upper holder 26 is shaped like a channel which opens forward, upward, and downward. The first and second upper holders 24 and 26 are joined with each other by receiving projections 24*b* formed on the side walls of the first upper holder 24 in hollows 26*a* formed on the side walls of the second upper holder 26.

An upper right side of the heat exchanger support structure, including the first stay 42 of the right cylindrical shroud member 4 and the upper holding portion 24 formed on the right fan shroud portion 21, is constructed similarly to the upper left side shown in FIGS. 4 and 5, but symmetrically with respect to a vertical center line, on the vertical rib 3*d*, of the heat exchanger support 3.

Figure 6:
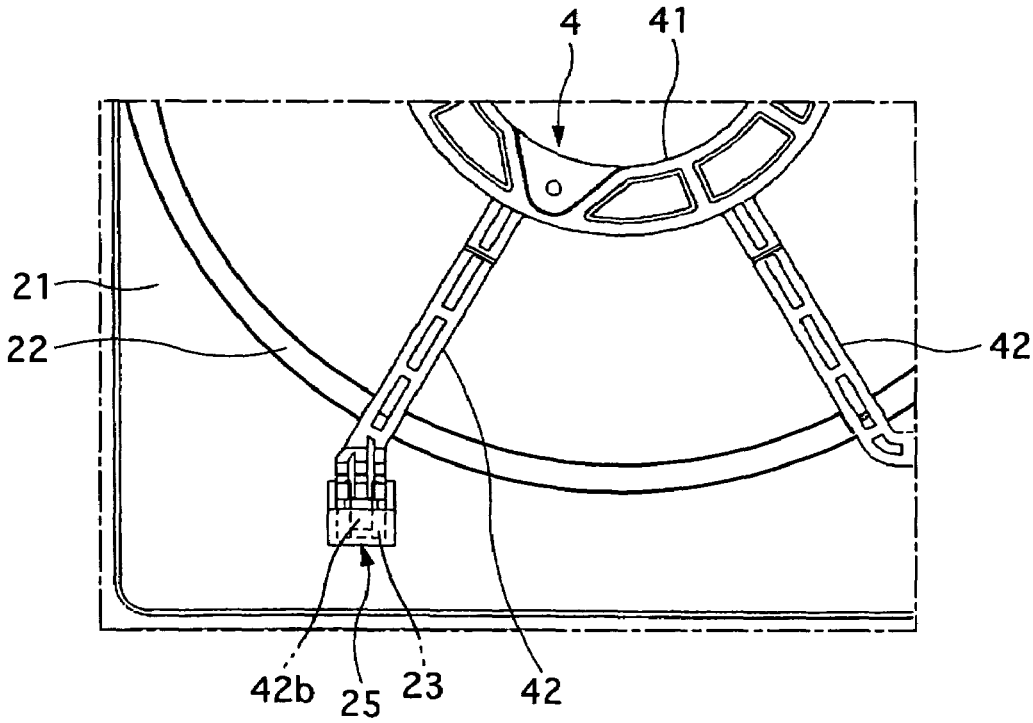
FIG. 6 is an enlarged fragmentary rear view of a lower left portion, indicated in a circle FB in FIG. 1, of the heat exchanger support structure shown in FIGS. 1 and 2, showing the motor fan shroud portion and the cylindrical shroud member with stays each extending outwardly in the radial direction.
Figure 7:
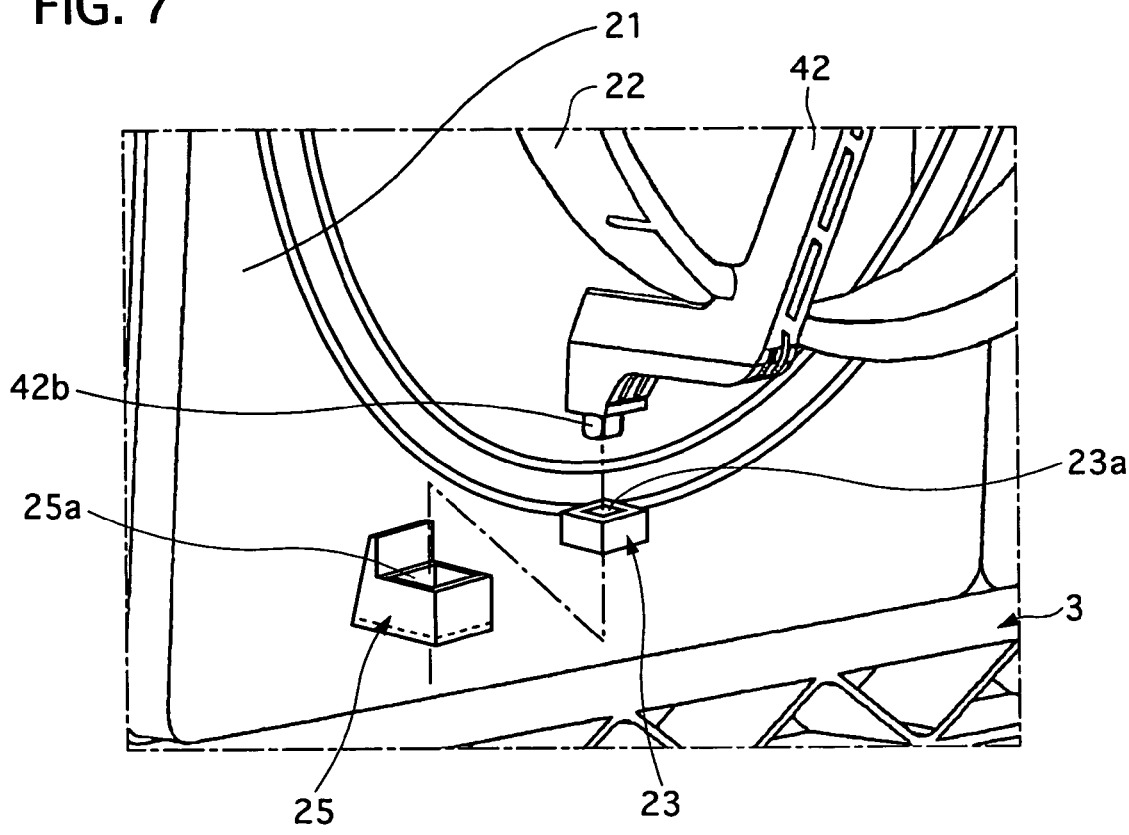
FIG. 7 is an exploded and enlarged fragmentary perspective rear view showing the lower left portion of FIG. 6, in a state that the stays are removed from a lower holding portion formed on the motor fan shroud portion.

FIGS. 6 and 7 show fragmentally and with enlargement the lower left portion of the heat exchanger support structure, the first stay 42 of the left cylindrical shroud member 4 and the lower holding portion 25 formed on the left fan shroud portion 21.

As shown in FIGS. 6 and 7, the first stay 42, extending toward the lower left direction, is provided with an inserting portion 42*b* at its bottom, which is received in a hole 23*a* of the elastic member 23 in the shape of a rectangular tube. The elastic member 23 is held by the lower holding portion 25, shaped like a box with a cavity 25*a* that opens upward to receive the elastic member 23, in a manner that a lower and all four side surfaces of the elastic member 23 are in contact with the inner surfaces of the lower holding portion 25.

A lower right side of the heat exchanger support structure, including the first stay 42 of the right cylindrical shroud member 4 and the lower holding portion 25 formed on the right fan shroud portion 21, is constructed similarly to the lower left side shown in FIGS. 6 and 7, but symmetrically with respect to the vertical center line of the heat exchanger support 3.

Next, an operation of the heat exchanger support structure will be described.

When there is a need of cooling by the heat exchanger 5, the motor fans 11 are driven by the electric motors 12 to suck air from the front side of the heat exchanger 5. This suction causes the air to pass through the heat exchanger 5, the shroud portions 21, and the second shroud ring portions 22 in turn, and the air is exhausted from the downstream edge portions 22*b* into an engine room, not shown.

In this air flow, the covering portions 21*b* block the shroud clearances between the first and second shroud portions 21 and 22, so that the air scarcely flows into the shroud clearances, which improves suction efficiency of air by the motor fan 11.

Besides, as the downstream edge portions 22*b* of the second shroud portions 22 are broadened in their internal diameters toward the ends, turbulent air flows caused by the motor fans 11 are straightened.

Incidentally, the dynamic imbalances of the motor fans 11 cause the motor fan units 1 to vibrate, which also shakes the heat exchanger support 3. Nevertheless, these vibrations are suppressed by a function of the dynamic dampers consisting of the motor fan units 1, the cylindrical shroud members 4, and the elastic members 23. Besides, the fan clearances between the second shroud portions 22 and the motor fans can be set smaller than the case where the motor fan is resiliently supported directly to a fan shroud of a heat exchanger support without using such a cylindrical member. This results from the fact that in the former arrangement, the motor fan units 1 are directly fixed to the cylindrical shroud member in which the air flows thus keeping the fan clearance constant, while in the latter arrangement, a broader clearance is needed so that the resiliently supported fan unit can shake in the fan shroud.

The entire contents of Japanese Patent Application (Tokugan) No. 2003-318815 filed Sep. 10, 2003 is incorporated herein by reference.

While there have been particularly shown and described with reference to preferred embodiments thereof, it will be understood that various modifications may be made therein, and it is intended to cover in the appended claims all such modifications as fall within the true spirit and scope of the invention.

For example, although the motor fan shroud portions 21 and 21 are integrally formed with the main frame 30 in the above embodiment, they may be replaced by separated parts, such as fan motor shrouds and a main frame, which are combined with (connected to) in the manufacturing process each other later.

Further, two sets of the motor fan units are not always necessary and it is possible to install only one set. Also, the configurations and the number of the stays 42 and 420 may be different from those of the above embodiment.

What is claimed is:

1. A heat exchanger support structure comprising:

a heat exchanger;

a motor fan to supply said heat exchanger with air flow;

an electric motor driving said motor fan;

a heat exchanger support supporting said heat exchanger;

a motor fan shroud fixed on one of said heat exchanger and said heat exchanger support and allowing the air flow caused by said motor fan to pass through said motor fan shroud; and a cylindrical shroud member which supports said electric motor and surrounds an outer periphery of said motor fan, said cylindrical shroud member having a plurality of stays resiliently supported to said motor fan shroud with a plurality of elastic members interposed between the plurality of stays and said motor fan shroud, respectively, wherein said motor fan shroud is provided with a plurality of holding portions for respectively holding said elastic members, each of said stays is provided with an inserting portion, and each of said elastic members has a rectangular tube shape with a hole to receive the inserting portion of a respective one of said stays of said cylindrical shroud member.

2. The heat exchanger support structure according to claim 1, wherein the holding portions include an upper holding portion having a first holder integrally formed to said motor fan shroud and a second holder attachable to and detachable from the first holder, the first and second holders holding one of the elastic members.

3. The heat exchanger support structure according to claim 2, wherein the first holder is shaped like a channel which has a top lid and opens rearward and downward, and the second holder is shaped like a channel which opens forward, upward and downward.

4. The heat exchanger support structure according to claim 3, wherein the first holder includes side walls with projections and the second holder includes sidewalls with hollows to receive the projections for joining the first and second holders to each other.

5. The heat exchanger support structure according to claim 1, wherein the holding portions include a lower holding portion shaped like a box which opens upwardly for receiving one of the elastic members.

6. The heat exchanger support structure according to claim 2, wherein the holding portions include a lower holding portion shaped like a box which opens upwardly for receiving another of the elastic members.

7. The heat exchanger support structure according to claim 1, wherein a clearance is provided in a radial direction of said motor fan between said cylindrical shroud member and said motor fan shroud, said motor fan shroud being provided with a covering portion at an inner edge portion thereof which covers the clearance so that the air flow through the clearance is blocked.

8. The heat exchanger support structure according to claim 1, wherein said cylindrical shroud member has an upstream portion having a constant internal diameter and a downstream edge portion having an internal diameter which broadens from the internal diameter of the upstream portion toward an end of the edge portion.

9. The heat exchanger support structure according to claim 1, wherein said motor fan shroud and said heat exchanger support are formed of resin separately from each other and thereafter connected to each other.

10. A method of supporting a heat exchanger, comprising:

supporting a heat exchanger on a heat exchanger support;

fixing a motor fan shroud on one of said heat exchanger and said heat exchanger support, said motor fan shroud being provided with a plurality of holding portions;

fixing an electric motor having a motor fan to a cylindrical shroud member which surrounds an outer periphery of said motor fan; and resiliently supporting a plurality of stays of said cylindrical shroud member to the motor fan shroud with a plurality of elastic members, each of said stays including an inserting portion and each of said elastic members having a rectangular tube shape with a hole to receive the inserting portion of a respective one of said stays, wherein each inserting portion is inserted into the hole of the respective elastic member and each elastic member is held in the respective holding portion of the motor fan shroud.

11. The method of supporting a heat exchanger according to claim 10, further including configuring the holding portions to include an upper holding portion having a first holder integrally formed to said motor fan shroud and configuring a second holder to be attachable to and detachable from the first holder for holding one of the elastic members.

12. The method of supporting a heat exchanger according to claim 11, further including configuring the first holder to be shaped like a channel having a top lid and opening rearward and downward, and the second holder to be shaped like a channel opening forward, upward and downward.

13. The method of supporting a heat exchanger according to claim 12, further including configuring the first holder to include side walls with projections and the second holder to include sidewalls with hollows for receiving the projections for joining the first and second holders to each other.

14. The method of supporting a heat exchanger according to claim 10, further including configuring the holding portions to include a lower holding portion shaped like a box opening upwardly for receiving the at least one of the elastic members.

15. The method of supporting a heat exchanger according to claim 11, further including configuring the holding portions to include a lower holding portion shaped like a box opening upwardly for receiving at least another of the elastic members.

16. The method of supporting a heat exchanger according to claim 10, further including providing a clearance in a radial direction of said motor fan between said cylindrical shroud member and said motor fan shroud and covering said clearance with a covering portion provided at an inner edge of said motor fan shroud so that the air flow through the clearance is blocked.

17. The method of supporting a heat exchanger according to claim 10, further including configuring said cylindrical shroud member to include an upstream portion having a constant internal diameter and configuring a downstream edge portion to have an internal diameter which broadens from the internal diameter at the upstream portion toward an end of the edge portion.

18. The method of supporting a heat exchanger according to claim 10, further including forming said motor fan shroud and said heat exchanger support of resin separately from each other and connecting said motor fan shroud and said heat exchanger shroud to each other.

19. A heat exchanger supporting structure comprising:

a heat exchanger;

a motor fan to supply said heat exchanger with air flow;

an electric motor driving said motor fan;

a heat exchanger support supporting said heat exchanger;

a motor fan shroud fixed on one of said heat exchanger and said heat exchanger support and allowing the air flow caused by said motor fan to pass through said motor fan shroud; and a cylindrical shroud member which supports said electric motor and surrounds an outer periphery of said motor fan, said cylindrical shroud member having a plurality of stays resiliently supported to said motor fan shroud with a plurality of elastic members interposed between the plurality of stays and said motor fan shroud, respectively, wherein a clearance is provided in a radial direction of said motor fan between said cylindrical shroud member and said motor fan shroud, said motor fan shroud being provided with a covering portion at an inner edge portion thereof which covers the clearance so that the air flow through the clearance is blocked.

20. A method of supporting a heat exchanger, comprising:

supporting a heat exchanger on a heat exchanger support;

fixing a motor fan shroud on one of said heat exchanger and said heat exchanger support, said motor fan shroud being provided with a plurality of holding portions;

fixing an electric motor having a motor fan to a cylindrical shroud member which surrounds an outer periphery of said motor fan;

resiliently supporting a plurality of stays of said cylindrical shroud member to the motor fan shroud with a plurality of elastic members respectively interposed between said plurality of stays and said motor fan shroud; and providing a clearance in a radial direction of said motor fan between said cylindrical shroud member and said motor fan shroud and covering said clearance with a covering portion provided at an inner edge of said motor fan shroud so that the air flow through the clearance is blocked.

* * * * *